US006224177B1

(12) United States Patent
Chu

(10) Patent No.: US 6,224,177 B1
(45) Date of Patent: May 1, 2001

(54) SLIDING TRACK ASSEMBLY

(75) Inventor: Leo Chu, Taipei Hsien (TW)

(73) Assignee: Yin Da Slide Co., Ltd., Taipei Hsien (TW)

( * ) Notice: Subject to any disclaimer, the term of this patent is extended or adjusted under 35 U.S.C. 154(b) by 0 days.

(21) Appl. No.: 09/642,649

(22) Filed: Aug. 22, 2000

(51) Int. Cl.[7] ..... A47B 88/04

(52) U.S. Cl. ..... 312/334.1; 312/334.46; 312/333

(58) Field of Search ..... 312/330.1, 333, 312/334.1, 334.7, 334.8, 334.11, 334.44, 334.46, 334.47; 384/18, 21, 22

(56) References Cited

U.S. PATENT DOCUMENTS 3,092,429 * 6/1963 Barnes ..... 312/334.8 X
4,549,773 * 10/1985 Papp et al. ..... 384/21 X
5,169,238 * 12/1992 Schenk ..... 384/21
5,433,517 * 7/1995 Fleisch ..... 312/334.8
5,757,109 * 5/1998 Parvin ..... 312/334.46 X

* cited by examiner

*Primary Examiner*—James O. Hansen
(74) *Attorney, Agent, or Firm*—Varndell & Varndell, PLLC

(57) ABSTRACT

A sliding track assembly includes an outer rail fixedly mounted inside a desk, the outer rail having a locating flange extended from a rear extension bar thereof, an inner rail moved with a drawer in and out of the outer rail, and positioning mechanism installed in a rear side of the inner rail for stopping the inner rail from jumping forwards relative to the outer rail each time the inner rail is moved with the drawer into the inside of desk, wherein the positioning mechanism includes a hollow fixed block fixedly fastened to the inner rail, and a movable block pivoted to the fixed block and turned between a first position where the movable block is received inside the fixed block and stopped at a front side of the locating flange of the rear extension bar of the inner rail and the inner rail is received inside the outer rail, and a second position where the movable block is extended out of the fixed block for enabling the inner rail to be moved with the drawer out of the desk.

4 Claims, 10 Drawing Sheets

SLIDING TRACK ASSEMBLY

BACKGROUND AND SUMMARY OF THE INVENTION

The present invention relates to a sliding track assembly for drawer, and more particularly to a simple structure of sliding track assembly, which can be positively positioned in the received position when the drawer is pushed back to the inside of the desk.

FIGS. 1 and 2 show a sliding track assembly for drawer according to the prior art. This structure of sliding track assembly comprises a positioning mechanism installed in the outer rail for holding the outer rail 4 in the received position. The positioning mechanism comprises a fixed block 1, a movable block 3, and a link 2 coupled between the fixed block 1 and the movable block 3. This structure of positioning mechanism is complicated, and its manufacturing cost is high. Further, if the user shifts the movable block 3 to an abnormal position due to an error during arrangement of the drawer, the locating flange 41 of the inner rail 4 can not act against the movable block 3, causing the inner rail 4 unable to be positively positioned in the received position.

The present invention has been accomplished to provide a positioning mechanism for a sliding track assembly for drawer, which eliminates the aforesaid drawbacks. According to one aspect of the present invention, the positioning mechanism is comprised of a fixed block, and a movable block pivoted to the fixed block and adapted to hold the inner rail positively in the received position. According to another aspect of the present invention, the fixed block and the movable block are respectively injection-molded from plastics, therefore the manufacturing cost of the positioning mechanism is inexpensive. According to still another aspect of the present invention, the movable block ahs guide means adapted for guiding the inner rail into the engaged position in the case the movable block is shifted out of the correct position.

DETAILED DESCRIPTION OF THE PREFERRED EMBODIMENT

Figure 1:
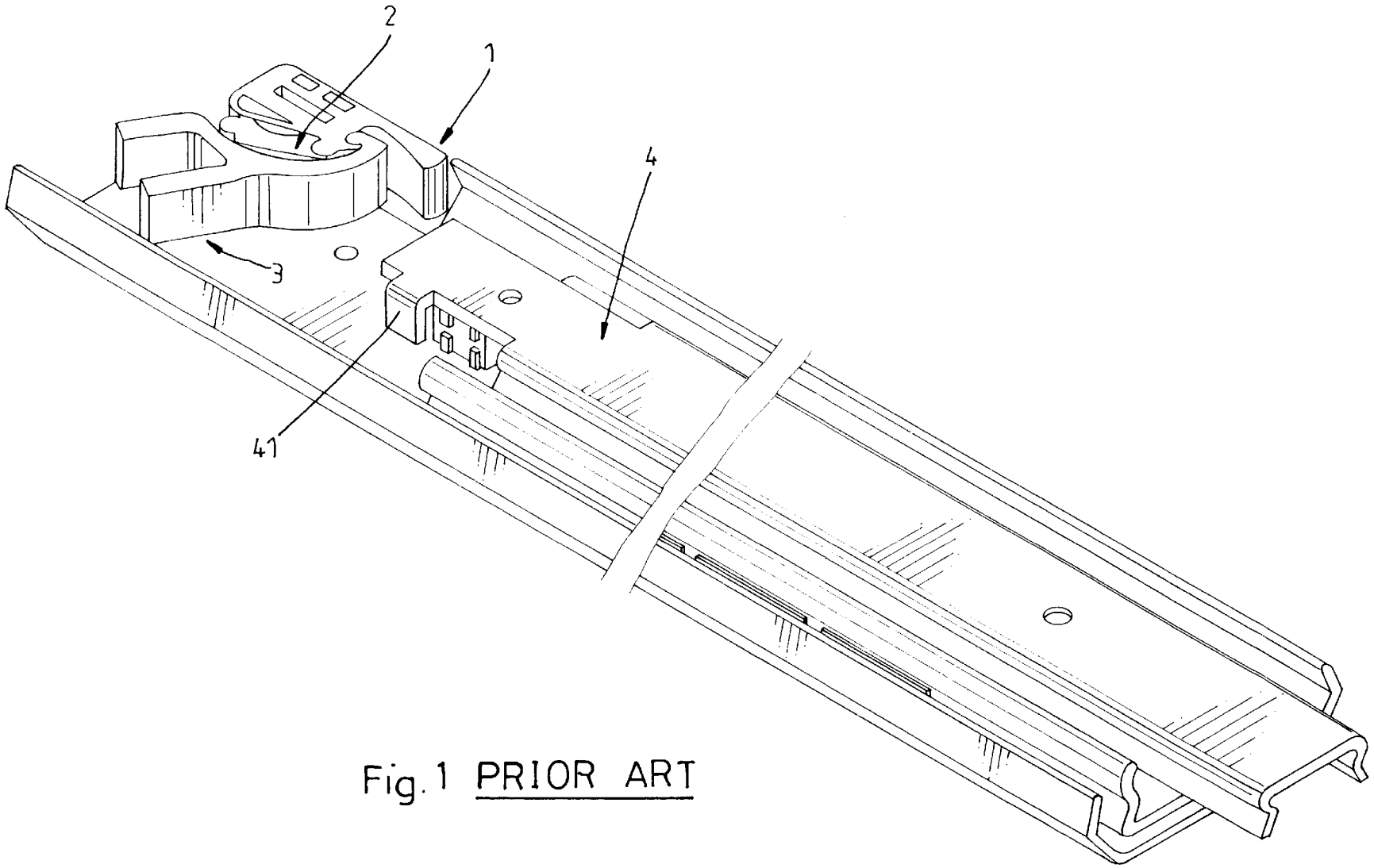
Fig. 1 PRIOR ART
FIG. 1 is a perspective view of a sliding track assembly for drawer according to the prior art.
Figure 2:
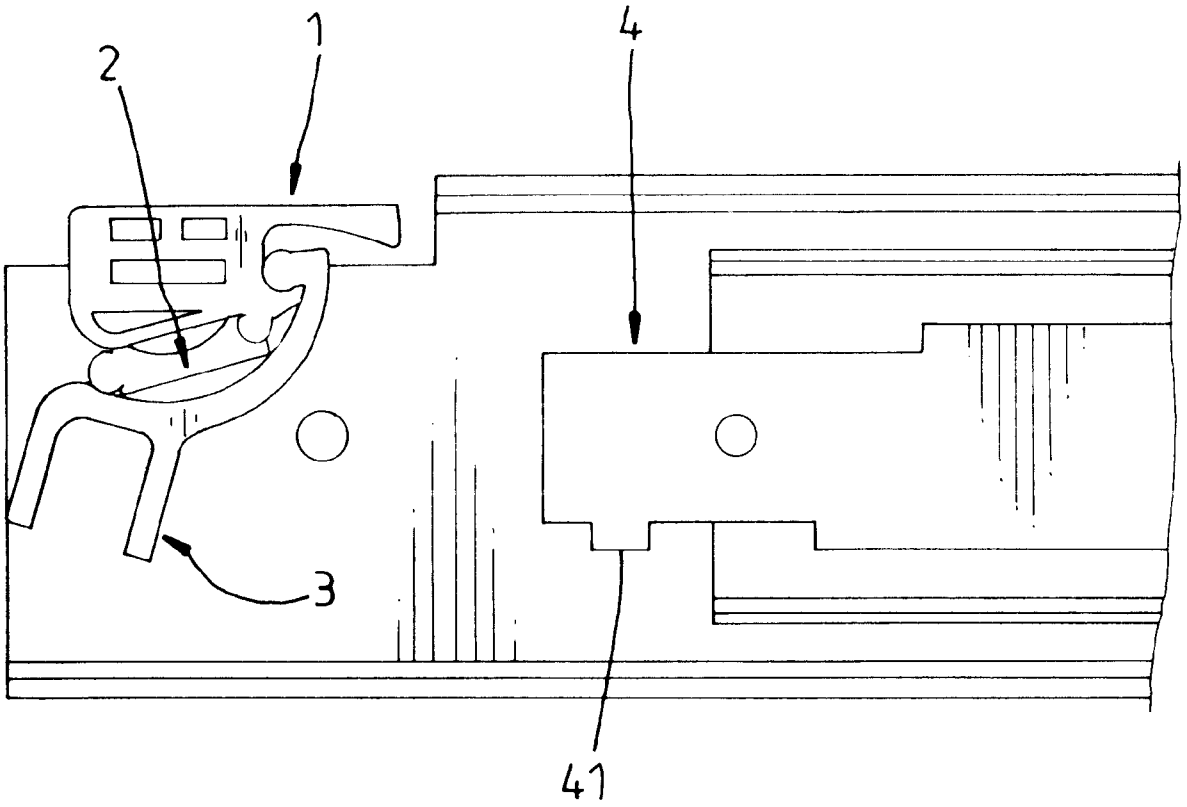
Fig. 2 PRIOR ART
FIG. 2 is a top plain view of a part of FIG. 2.

Referring to Figures from 3 through 8, a sliding track assembly in accordance with the present invention comprises an outer rail 6, an intermediate rail 7, an inner rail 8, a first sliding bearing 91 coupled between the outer rail 6 and the intermediate rail 7, and a second sliding bearing 92 coupled between the intermediate rail 7 and the inner rail 8. The outer rail 6 is fixedly fastened to the inside wall of, for example, a desk (not shown). The inner rail 8 is fixedly fastened to one lateral side wall of a drawer (not shown). The intermediate rail 7 is coupled between the outer rail 6 and the inner rail 8, and moved in and out of the outer rail 6. The drawer can be moved with the inner rail 8 in and out of the desk, and detached with the inner rail 8 from the intermediate rail 7.

The inner rail 8 comprises a rear extension bar 82. The rear extension bar 82 comprises a retaining notch 83 at one side, a locating flange 84 at one side of the retaining notch 83. When the drawer is moved with the inner rail 8 backwardly to the inside of the desk, the locating flange 84 is forced into engagement with a positioning mechanism 5 at the rear side of the outer rail 6 to stop the inner rail 8 and the drawer from jumping forwards. When pulling the drawer outwards with force, the locating flange 84 is disengaged from the positioning mechanism 5, enabling the drawer to be moved out of the desk.

The positioning mechanism 5 is comprised of a fixed block 51, and a movable block 52. The fixed block 51 and the movable block 52 are respectively injection-molded from plastics The fixed block 51 comprises a plurality of mounting slots 511 adapted for fastening to the outer rail 6, two parallel lateral side walls 513, a front side wall 512 connected between the lateral side walls 513 at a front side and defining with the lateral side walls 513 an open chamber 514, and two pivot holes 5131 aligned at the lateral side walls 513. The movable block 52 comprises a first clamping arm 521 and a second clamping arm 522 spaced by a gap 520, a protruded locating flange 523 extended from an outer side of the second clamping arm 522. The first clamping arm 521 and the second clamping arm 522 are clamped on the front sidewall 512 of the fixed block 51. The first clamping arm 521 is shorter than the second clamping arm 522, having two pivot rods 5211 raised from two opposite lateral side walls thereof and respectively coupled to the pivot holes 5131 of the fixed block 51.

Figure 6:
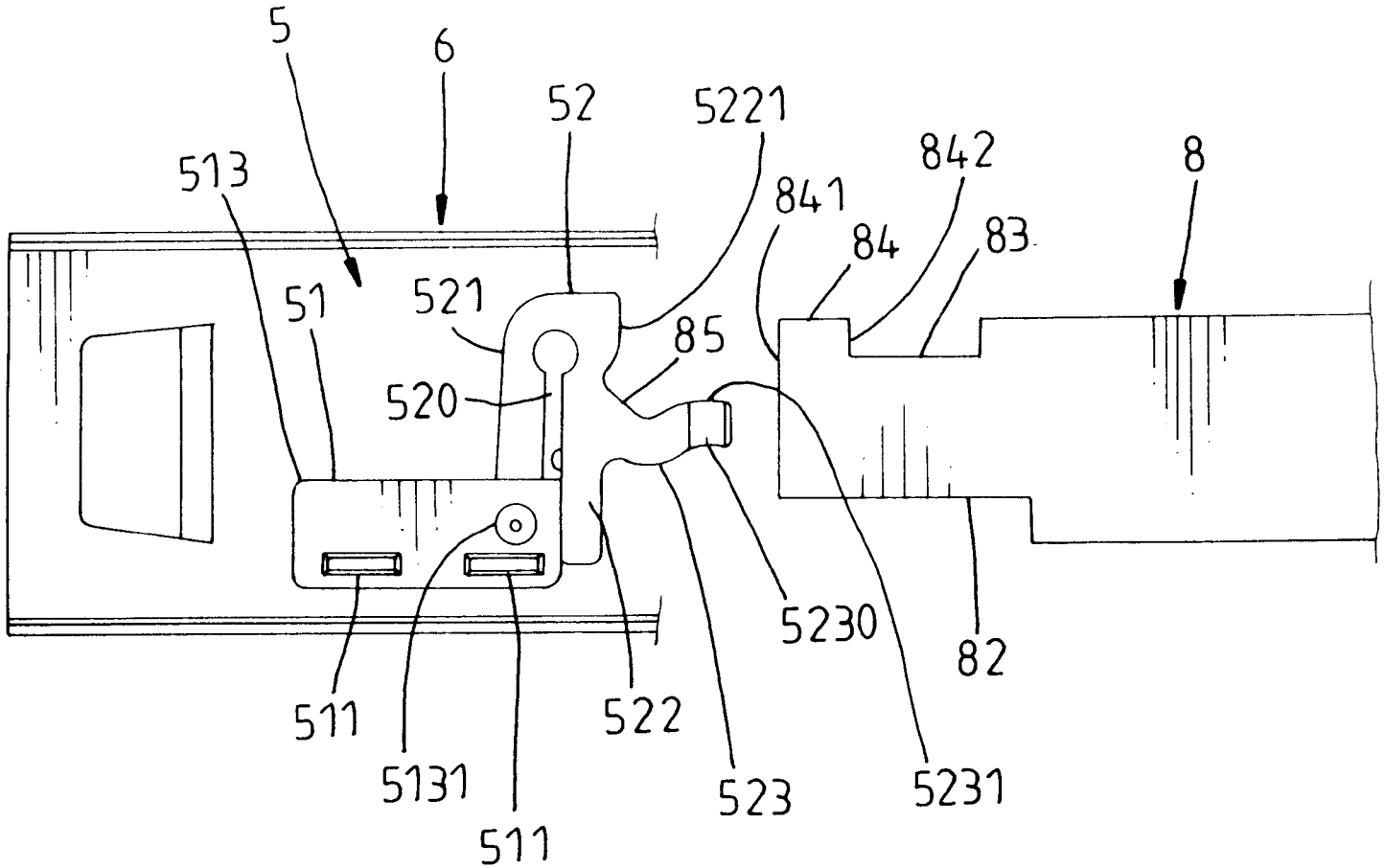
FIG. 6 is a sectional view of a part of the present invention, showing the relationship between the inner rail and the positioning mechanism in the outer rail.
Figure 7:
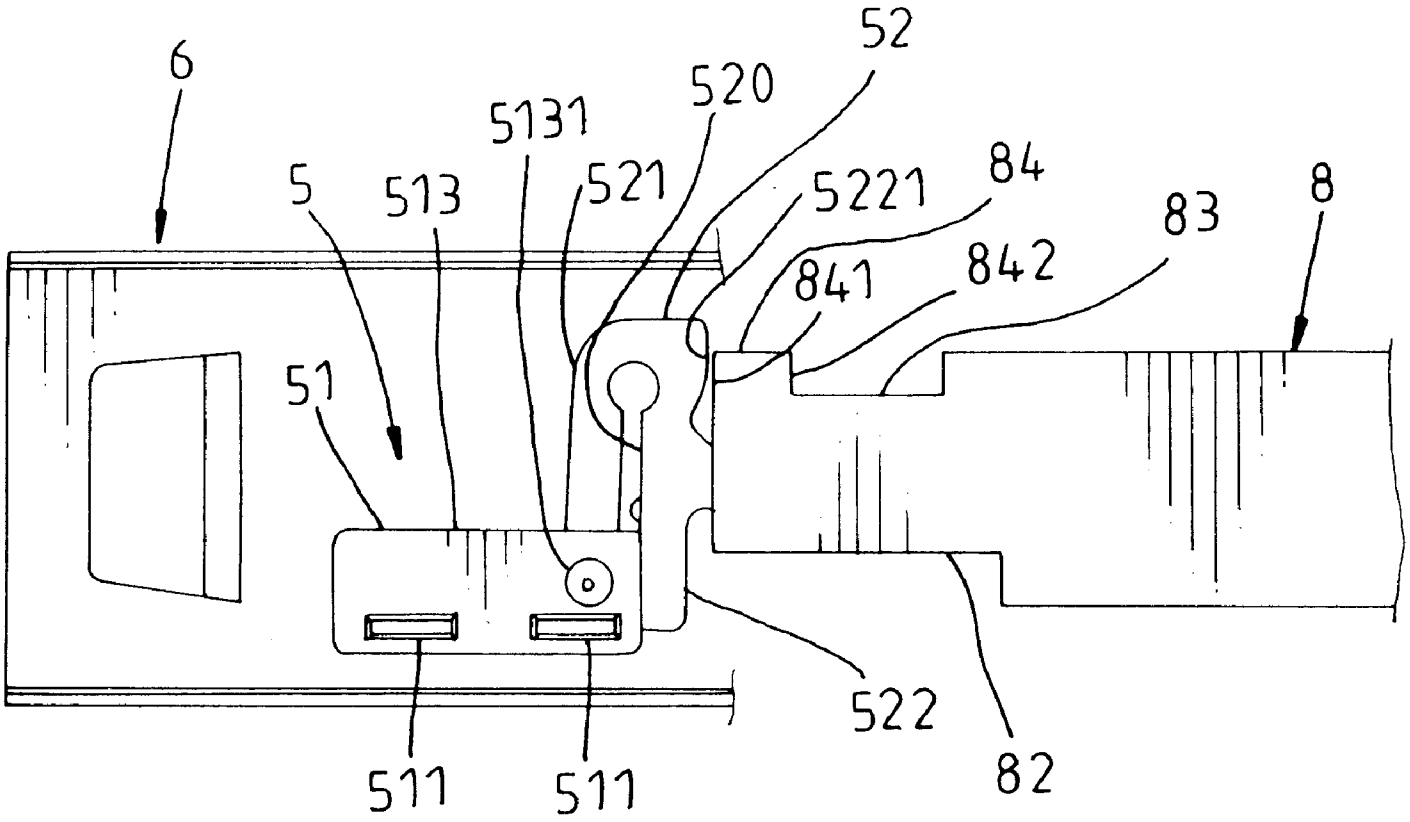
FIG. 7 is a similar to FIG. 6 but showing the locating flange of the rear extension bar of the inner rail moved to the locating flange of the movable block of the positioning mechanism.
Figure 8:
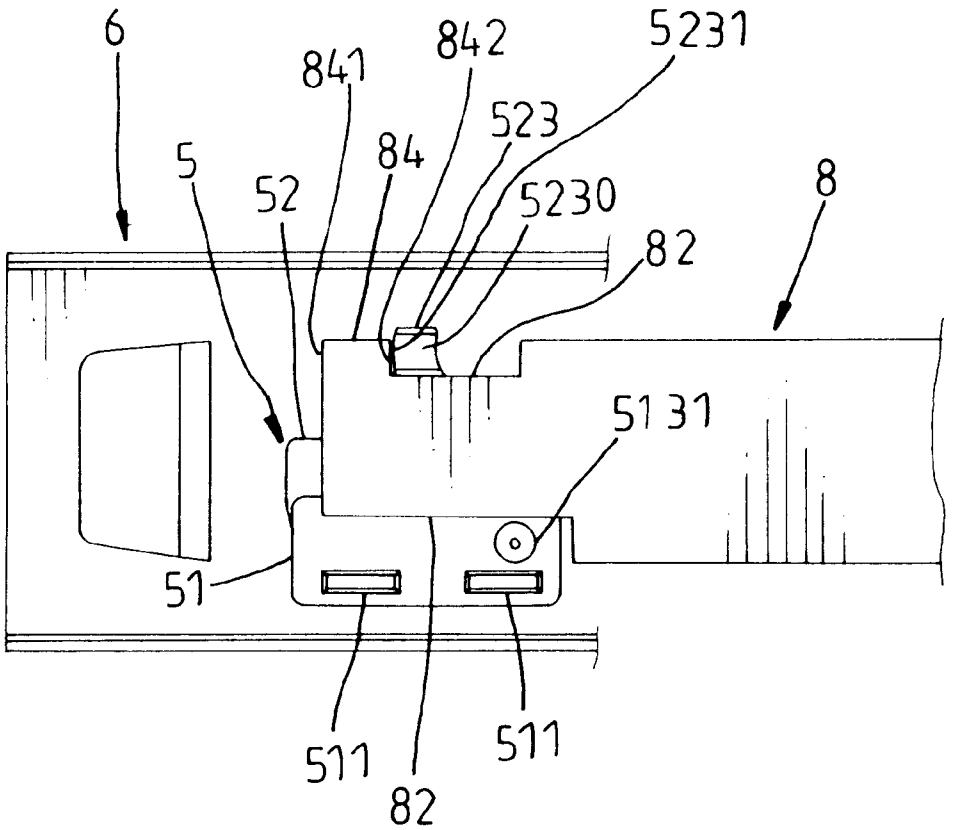
FIG. 8 is similar to FIG. 7 but showing the locating flange of the rear extension bar of the inner rail forced into engagement with the locating flange of the movable block of the positioning mechanism.

Referring to Figures from 6 through 8 again again, when the inner rail 8 is moved backwards with the drawer, the rear side 841 of the locating flange 84 is forced against the upper part 5221 of the second clamping arm 522 of the movable block 52, thereby causing the movable block 52 to be turned in one direction relative to the fixed block 51 and then received in the open chamber 514 of the fixed block 51. After the movable block 52 received in the open chamber 514, the locating flange 523 of the movable block 52 is stopped at the front side 842 of the locating flange 84 to prohibit the inner rail 8 from forward (outward) movement (see FIG. 8). On the contrary, when pulling the drawer outwards, the front side 842 of the locating flange 84 imparts a forward pressure to the locating flange 523 of the movable block 52, thereby causing the movable block 52 to be turned relative to the fixed block 51 in the reversed direction and extended out of the open chamber 514 of the fixed block 51. At the same time, the second clamping arm 522 is moved over the topmost edge 5121 of the front side wall 512 and clamped with the first clamping arm 521 on the front side wall 512 of the fixed block 51 (see FIG. 6), and the locating flange 84 of the rear extension bar 82 of the inner rail 8 is moved over the top side 5231 of the locating flange 523 of the movable block 52, enabling the inner rail 8 to be moved with the drawer out of the desk smoothly.

Figure 4:
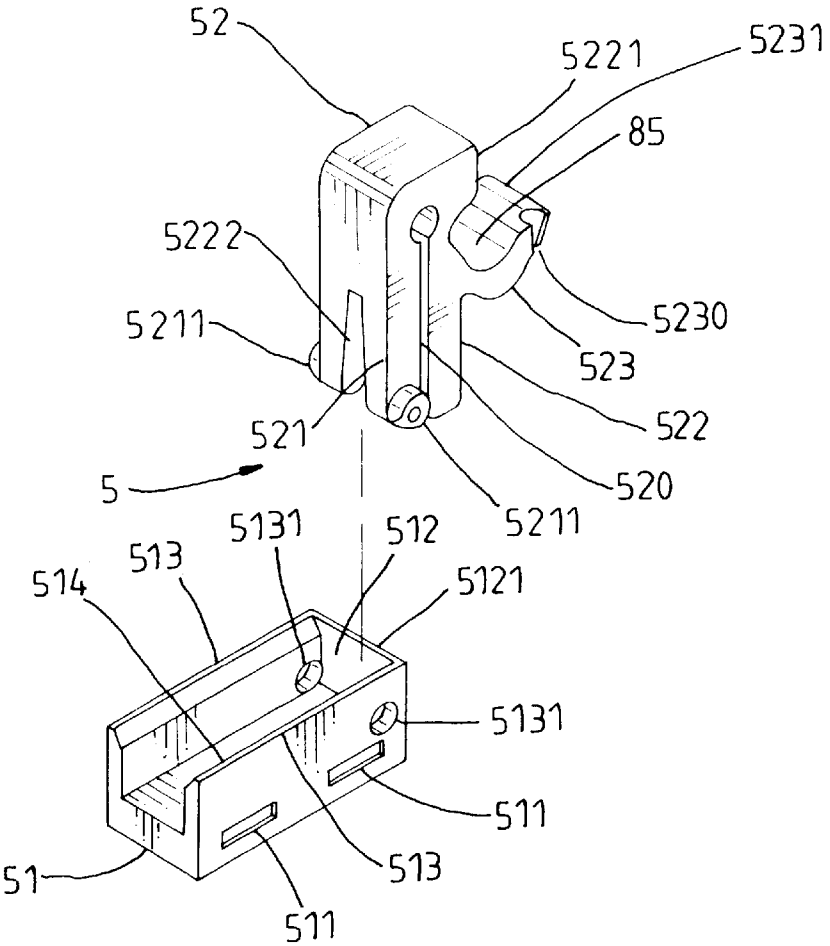
FIG. 4 is an exploded view of the positioning mechanism for the sliding track assembly according to the present invention.
Figure 5:
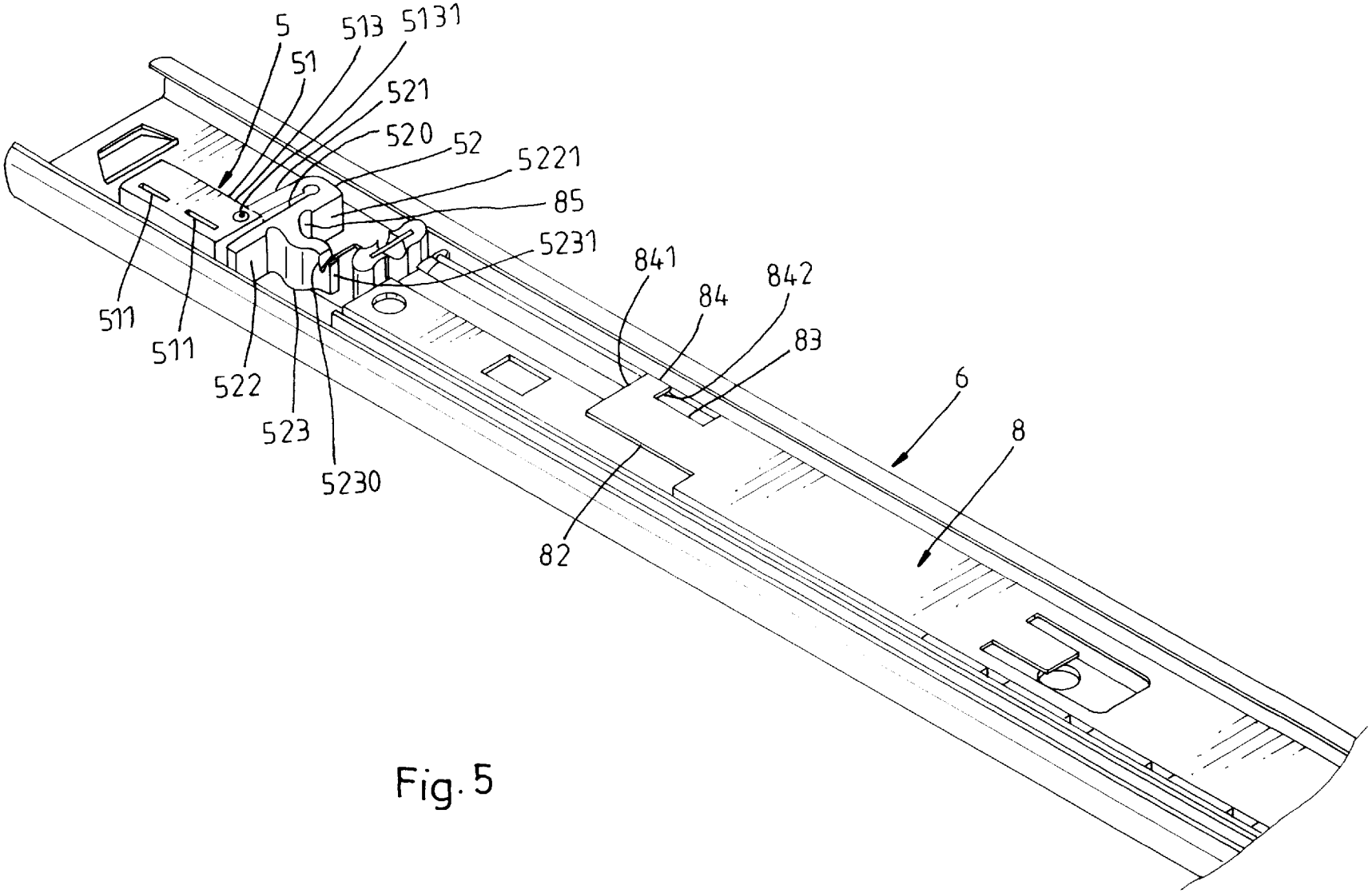
FIG. 5 is a perspective assembly view of the sliding track assembly according to the present invention.
Figure 9:
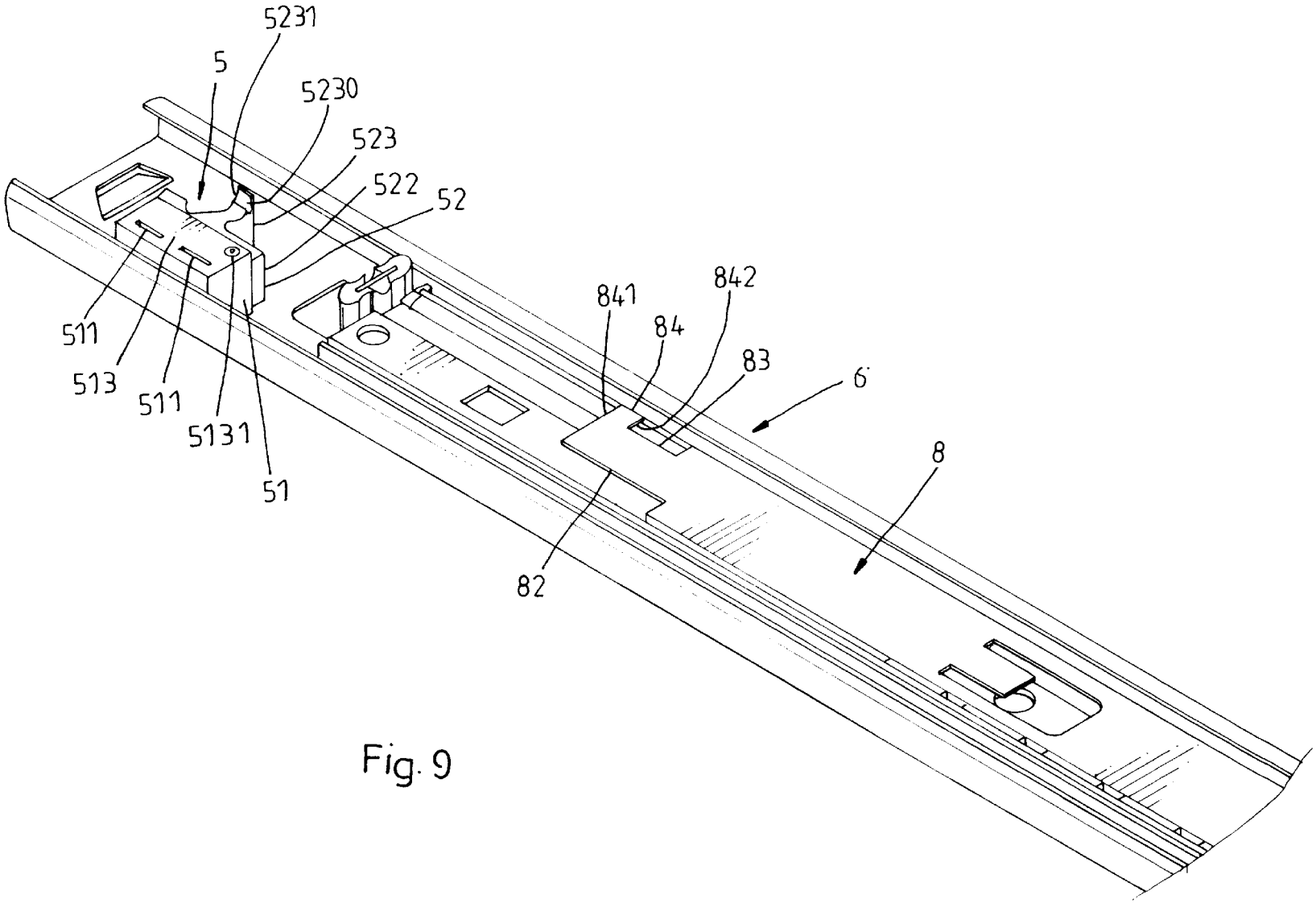
FIG. 9 is similar to FIG. 5 but showing the movable block received in the open chamber of the fixed block.

Referring to FIG. 9 and FIG. 4 again, the locating flange 523 of the movable block 52 has a sloping guide face 5230 near the topside 5231. If the movable block 52 is not disposed in the correct position (if the movable block 52 is not extended out of the open chamber 514 of the fixed block 51) after the inner rail 8 has been extended out of the intermediate rail 7, the rear side 841 of the locating flange 84 can still be moved over the top side 5231 of the locating flange 523 of the movable block 52 through the sloping guide face 5230, enabling the front side 842 of the locating flange 84 of the rear extension bar 82 to be forced into engagement with the top side 5231 of the locating flange 523 of the movable block 52.

Figure 3:
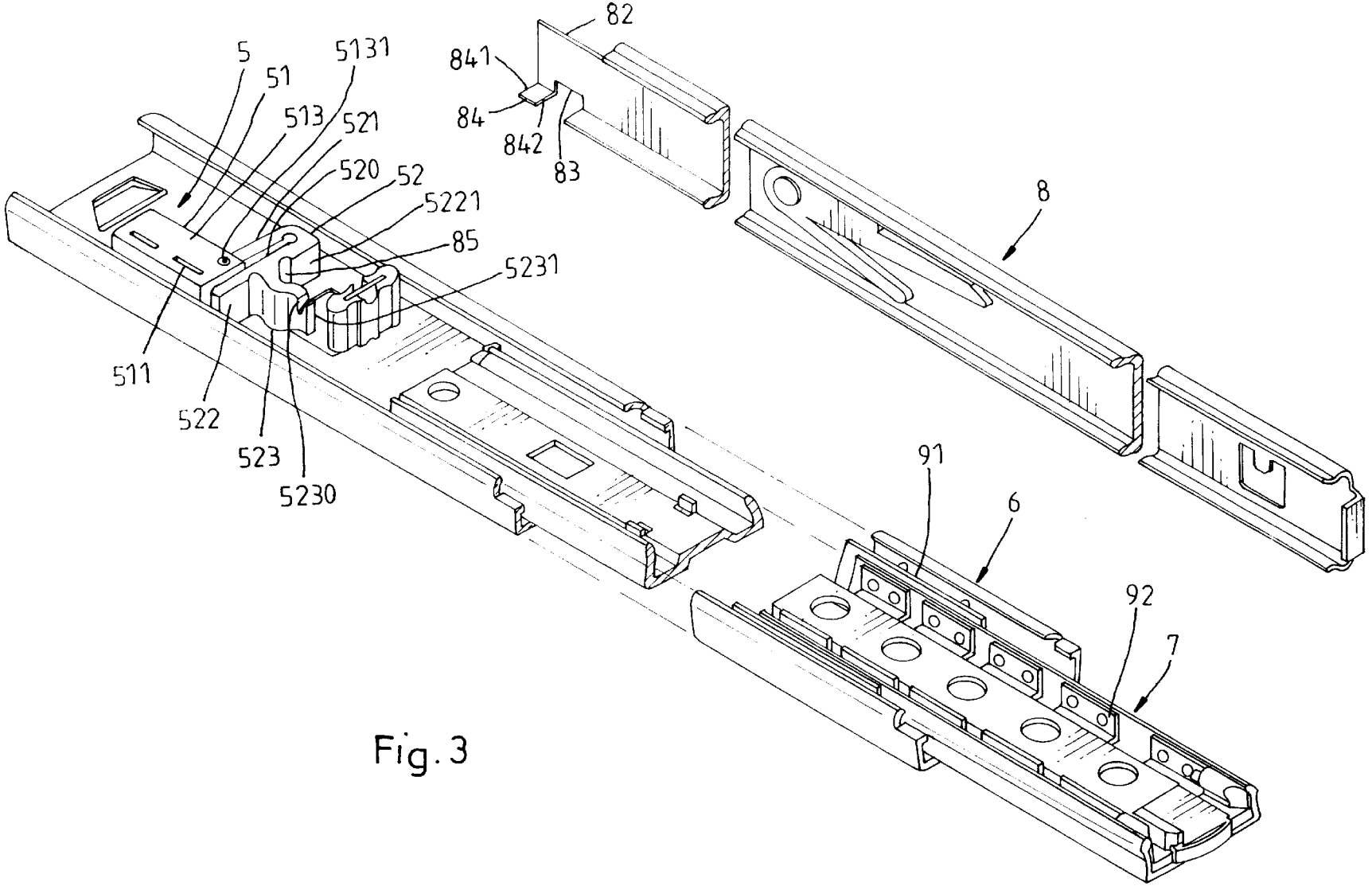
FIG. 3 is an exploded view of a sliding track assembly according to the present invention.

Referring to FIGS. 3 and 4 again, the movable block 52 further comprises a guide groove 85 disposed between the upper part 5221 of the second clamping arm 522 and the top side 5231 of the locating flange 523 for enabling the movable block 52 to be smoothly turned in and out of the open chamber 514 of the fixed block 51. The first clamping arm 521 has a longitudinally extended end notch 5222, which enables the pivot rods 5211 to be squeezed inwards toward each other for easy installation in the pivot holes 5131 of the fixed block 51.

Figure 10:
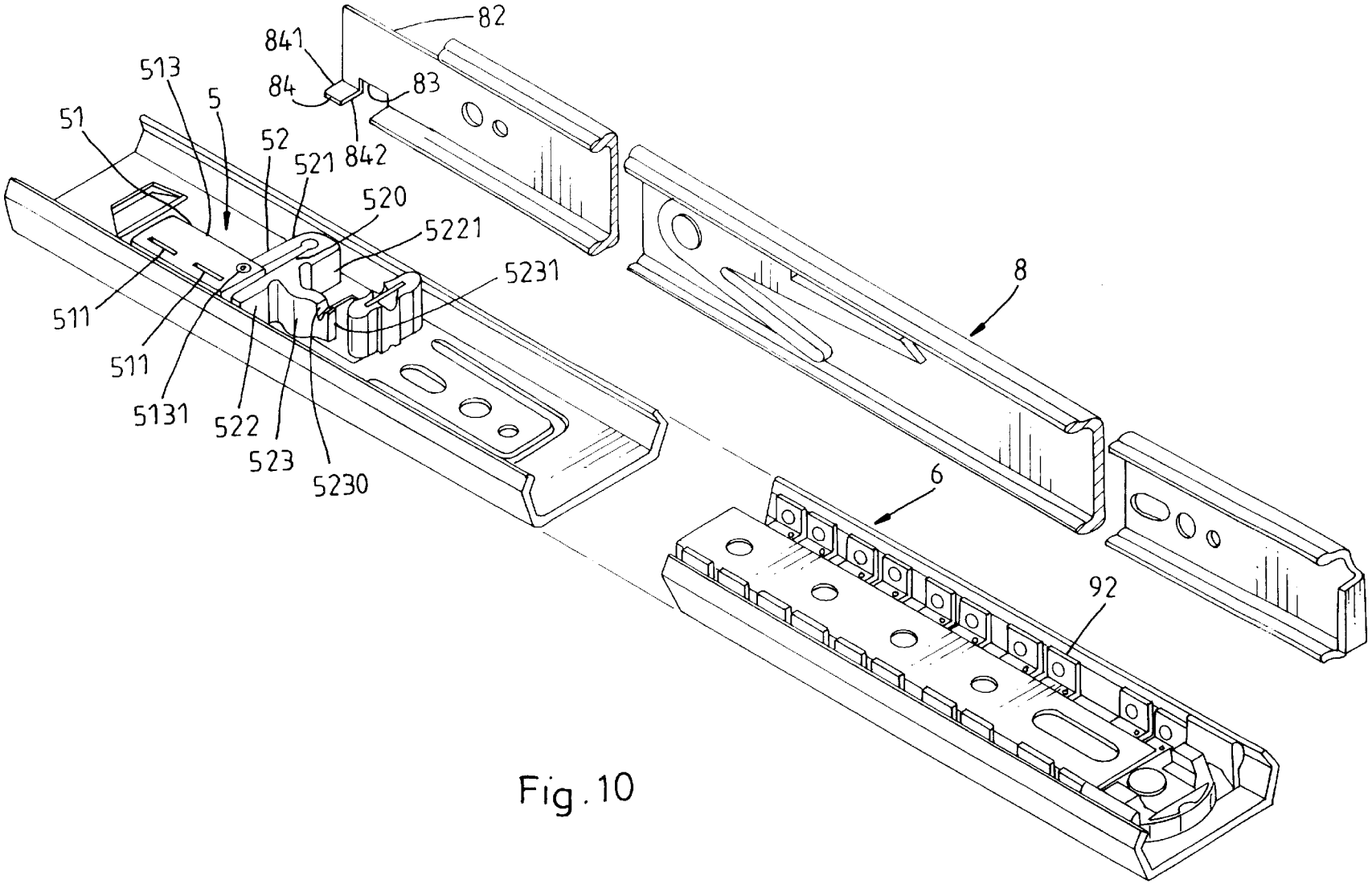
FIG. 10 is an exploded view of a sliding track assembly according to an alternate form of the present invention.

FIG. 10 shows an alternate form of the present invention. According to this alternate from, the sliding track assembly is comprised of an outer rail 6, an inner rail 8, a sliding beating 92 coupled between the outer rail 6 and the inner rail 8, and a positioning mechanism 5 installed in the rear side of the outer rail 6. This alternate form eliminates the aforesaid intermediate rail 7 and first sliding bearing 91.

What is claimed is:

1. A sliding track assembly comprising:

an outer rail fixedly fastened to the inside wall of a first device;

a positioning mechanism installed in a rear side of said outer rail;

an inner rail fixedly fastened to a second device and moved with said second device in and out of said outer rail, said inner rail comprising a rear extension bar, said rear extension bar comprising a retaining notch at one side, and a locating flange disposed at one side of said retaining notch and adapted for engaging said positioning mechanism to stop said inner rail from jumping forwards relative to said outer rail each time said inner rail is moved with said second device into the inside of said first device; and a sliding bearing coupled between said outer rail and said inner rail;

wherein said positioning mechanism comprises:

a fixed block injection-molded from plastics and fixedly fastened to said outer rail, said fixed block comprising two parallel lateral side walls, a front side wall connected between said lateral side walls at a front side and defining with said lateral side walls an open chamber, said lateral side walls each having a pivot hole; and a movable block coupled to said fixed block and turned relative to said fixed block between a first position where said movable block is received in the open chamber of said fixed block and stopped at a front side of the locating flange of the rear extension bar of said inner rail and said inner rail is received inside said outer rail, and a second position where said movable block is extended out of the open chamber of said fixed block, said movable block comprising a first clamping arm and a second clamping arm spaced by a gap and adapted to clamp on the front side wall of said fixed block to hold said movable block in said second position, and a protruded locating flange extended from an outer side of said second clamping arm and adapted to engage into the retaining notch of the rear extension bar of said inner rail and to stop at a front side of the locating flange of the rear extension bar of said inner rail when said inner rail is received inside said outer rail said first clamping arm comprising two pivot rods raised from two opposite lateral side walls thereof and respectively coupled to the pivot holes of said fixed block for enabling said movable block to be turned between said first position and said second position.

2. The sliding track assembly of claim 1 wherein said protruded locating flange of said movable block comprises a sloping guide face near a top side thereof adapted for guiding the locating flange of the rear extension bar of said inner rail over the protruded locating flange of said movable block when said inner rail is moved with said second device into the inside of said outer rail.

3. The sliding track assembly of claim 1 wherein said movable block comprises a guide groove disposed between an upper part of said second clamping arm and the top side of the protruded locating flange of said movable block for enabling said movable block to be turned in and out of the open chamber of said fixed block.

4. The sliding track assembly of claim 1 wherein said first clamping arm of said movable block has a longitudinally extended end notch spaced between said pivot rods for enabling said pivot rods to be squeezed inwards toward each other for installation in the pivot holes of said fixed block.

* * * * *